US010907276B2

(12) United States Patent
De Keyzer et al.

(10) Patent No.: US 10,907,276 B2
(45) Date of Patent: Feb. 2, 2021

(54) FIRE-RETARDANT ARTIFICIAL GRASS

(71) Applicant: BFS Europe NV, Kruisem (BE)

(72) Inventors: Daan Robert De Keyzer, Deerlijk (BE); Marc Verleyen, Hulste (BE); Joris Degroote, Harelbeke (BE)

(73) Assignee: BFS Europe NV, Kruisem (BE)

( * ) Notice: Subject to any disclaimer, the term of this patent is extended or adjusted under 35 U.S.C. 154(b) by 299 days.

(21) Appl. No.: 15/541,877

(22) PCT Filed: Jan. 14, 2016

(86) PCT No.: PCT/EP2016/050642
§ 371 (c)(1),
(2) Date: Jul. 6, 2017

(87) PCT Pub. No.: WO2016/113342
PCT Pub. Date: Jul. 21, 2016

(65) Prior Publication Data

US 2017/0362743 A1 Dec. 21, 2017

(30) Foreign Application Priority Data

Jan. 16, 2015 (EP) ..... 15151516

(51) Int. Cl.
*E01C 13/08* (2006.01)
*D01F 1/07* (2006.01)
(Continued)

(52) U.S. Cl.
CPC ..... *D01F 1/07* (2013.01); *D01F 6/04* (2013.01); *E01C 13/08* (2013.01); *D01F 1/106* (2013.01);
(Continued)

(58) Field of Classification Search
CPC .... E01C 13/08; D06N 7/0065; D06N 7/0068; D06N 7/0071; D06N 7/0073;
(Continued)

(56) References Cited

U.S. PATENT DOCUMENTS 4,246,359 A * 1/1981 Whelan ..... C08K 3/22 521/139
4,788,008 A * 11/1988 Neubert ..... C08F 214/08 106/18.14
(Continued)

FOREIGN PATENT DOCUMENTS

CN 103952963 A 7/2014
CN 107574600 A * 1/2018
(Continued)

OTHER PUBLICATIONS

Google Patents translation for JP 2010-163760 A, 2010.*
(Continued)

*Primary Examiner* — Cheryl Juska
(74) *Attorney, Agent, or Firm* — Dinsmore & Shohl, LLP

(57) ABSTRACT

Artificial grass (100, 200, 320) with good fire-retardant performance including its manufacturing process (300) is disclosed, particularly to be used for indoor applications. The fire retardant, particularly of halogen-based type (311), is incorporated within the artificial fiber filaments (101, 201, 301). The backing (102, 202, 302) onto which the artificial fiber filaments (101, 201, 301) are attached, may also be provided with a fire retardant.

11 Claims, 3 Drawing Sheets

(51) Int. Cl.
*D01F 6/04* (2006.01)
*D01F 1/10* (2006.01)

(52) U.S. Cl.
CPC ..... *D06N 2201/0254* (2013.01); *D06N 2205/023* (2013.01); *D06N 2209/067* (2013.01); *D10B 2505/202* (2013.01); *Y10T 428/23936* (2015.04); *Y10T 428/23979* (2015.04); *Y10T 428/23993* (2015.04)

(58) Field of Classification Search
CPC ..... D06N 2201/0254; D06N 2205/023; D06N 2209/067; D01F 1/07; D01F 6/04; D01F 1/106; Y10T 428/23936; Y10T 428/23979; Y10T 428/23993; D10B 2505/202
See application file for complete search history.

(56) References Cited

U.S. PATENT DOCUMENTS

| | | | | | |
|---|---|---|---|---|---|
| 4,857,566 | A * | 8/1989 | Helbling | C08G 59/68 | 523/409 |
| RE34,951 | E * | 5/1995 | Slosberg | D06N 3/0063 | 427/355 |
| 2008/0139752 | A1 | 6/2008 | De Schryver et al. | | |
| 2010/0152352 | A1* | 6/2010 | Barber | C08K 3/22 | 524/296 |
| 2010/0330288 | A1* | 12/2010 | Segars | B29B 17/02 | 427/407.1 |
| 2012/0263892 | A1 | 10/2012 | Rodgers | | |
| 2013/0030123 | A1* | 1/2013 | Martin | E01C 13/08 | 525/95 |
| 2013/0078394 | A1* | 3/2013 | Taylor | C08L 23/06 | 428/17 |
| 2013/0130123 | A1* | 5/2013 | Kaneda | H01M 2/16 | 429/233 |
| 2013/0209707 | A1* | 8/2013 | Sandkuehler | E01C 13/083 | 428/17 |
| 2013/0273268 | A1* | 10/2013 | Luijkx | E01C 13/08 | 428/17 |
| 2015/0176201 | A1* | 6/2015 | Flendrig | D06N 7/0076 | 428/95 |
| 2017/0121856 | A1* | 5/2017 | Sick | D01F 1/10 | |
| 2017/0166770 | A1* | 6/2017 | Hall, Jr. | D06N 3/0063 | |
| 2017/0166771 | A1* | 6/2017 | Hall, Jr. | D06N 7/0071 | |
| 2017/0226332 | A1* | 8/2017 | Wang | B32B 5/022 | |
| 2017/0260362 | A1* | 9/2017 | Pfaendner | C08K 5/34928 | |
| 2018/0058017 | A1* | 3/2018 | Schmitz | D01F 6/90 | |
| 2018/0289191 | A1* | 10/2018 | Cochran, III | A47G 27/02 | |
| 2018/0355553 | A1* | 12/2018 | Coon | A47G 27/02 | |
| 2019/0145057 | A1* | 5/2019 | Beauprez | D05C 15/12 | |

FOREIGN PATENT DOCUMENTS

| | | | | | |
|---|---|---|---|---|---|
| CN | 109735913 | A | * | 5/2019 | |
| CN | 109837607 | A | * | 6/2019 | D01F 1/07 |
| CN | 209010897 | U | * | 6/2019 | |
| CN | 110055859 | A | * | 7/2019 | |
| CN | 110628124 | A | * | 12/2019 | |
| EP | 0691425 | A1 | | 1/1996 | |
| JP | S61282419 | A | | 12/1986 | |
| JP | 04352810 | A | * | 12/1992 | |
| JP | 2000303257 | A | * | 10/2000 | |
| JP | 2004143637 | A | | 5/2004 | |
| JP | 2010163760 | A | | 7/2010 | |
| JP | 5183405 | B2 | | 4/2013 | |
| KR | 1858450 | B1 | * | 6/2018 | |
| KR | 2143595 | B1 | * | 8/2020 | |
| WO | WO-2019081771 | A1 | * | 5/2019 | D01F 1/07 |

OTHER PUBLICATIONS

International Search Report and Written Opinion dated Apr. 1, 2016 for PCT/EP2016/050642 Filed Jan. 14, 2016. pp. 1-8.
Extended European Search Report dated May 5, 2015 for Application No. 15151516.0 Filed Jan. 16, 2015. pp. 1-6.
Edward D. Weil, Sergei V. Levchik, Flame Retardants for Plastics and Textiles, Practical Applications, 2009, pp. 6-11, 34-35, and 284-285, 2nd Edition, Hanser Publishers, Munich.

* cited by examiner

FIRE-RETARDANT ARTIFICIAL GRASS

FIELD OF THE INVENTION

The present invention relates to fire-retardant artificial grass, and its manufacturing process.

BACKGROUND OF THE INVENTION

Typically artificial grass is very combustible since it is almost entirely made from a polyolefin (PE/PP) material. Since artificial grass is used more and more for indoor applications, such as for instance exhibitions and trade shows, the demand for fire retardant classifications for these type of products is increasing. In Europe one standard to classify fire retardant products is EN 13501-1, i.e. the fire classification of construction products and building elements using test data from reaction to fire tests. Highest performance fire retardant class $B_{fl}$ is achieved when meeting the requirements according to standardized test procedures EN ISO 9239-1 and EN ISO 11925-2.

Various attempts have been done to reach the required standard by incorporating fire retardant materials in the latex backing of artificial grass, which is used to fix the pile structure, since this is a well-known, cheap and frequently used method in regular tufted carpet (not artificial grass). More specifically, the use of alumina trihydrate (ATH), which works through water release at high temperatures, is very common and widely used for many applications. However, in case of high pile (e.g. >8 mm) artificial grass, these attempts are rather unsuccessful. The amount, height and density of the pile material compared to the amount of flame retardant latex backing is far too high to give the desired fire retarding effect.

Two categories of fire retardant materials are known, i.e. the organic and the inorganic fire retardants. Organic fire retardants include for example halogen-based fire retardants, while inorganic fire retardants include for example alumina trihydrate, ammonium chloride, or boric acid.

However, the use of fire retardants in the backing only, seems to be insufficient to achieve the fire retardant class $B_{fl}$.

Other solutions of incorporating fire retardant in artificial grass include for example the use of infills with fire retardant as described in US2012263892. During the fire testing, the infill will prevent flame spread because the flame cannot reach the fiber filaments that are in the infill layer. The use of fire-retardant infills is particularly useful for outdoor sports grass where infills are commonly used.

In other executions, a fire retardant is incorporated within the artificial fiber filaments.

For example, CN103952963 refers to nitrogen- or phosphorous-based fire retardants.

JP5183504 describes the use of a nitrogen-based fire retardant, alone or in combination with other types of fire retardant, in the filaments of outdoor sports grass. Here, two different types of grass yarns with different heights are used for achieving good fire retardancy on the one hand, and good abrasion resistance on the other hand. The fire retardant is particularly used in the short grass blade, due to the trade-off of abrasion versus fire resistance. However, JP5183504 is completely silent about the fire retardancy performance. Moreover, the use of two types of fiber filaments with different material compositions and different heights for the manufacturing of artificial grass is rather complex and not preferred.

The present invention aims to provide artificial grass, in particular for indoor use, with high fire-retardant performance, herewith referring to highest European fire retardant class ($B_{fl}$), including long pile artificial fiber filaments.

SUMMARY OF THE INVENTION

According to a first aspect, the present invention relates to an artificial fiber filament, for forming artificial grass, comprising a polyolefin material and a halogen-based fire retardant material.

According to a second aspect, the present invention relates to artificial grass comprising a plurality of artificial fiber filaments and a backing, wherein the artificial fiber filaments that are extending from the backing, comprise a halogen-based fire retardant material.

According to a third aspect, the present invention relates to the use of artificial fiber filaments comprising a halogen-based fire retardant material for forming an artificial grass, in particular for indoor applications.

According to a fourth aspect, the present invention relates to a process for producing artificial fiber filaments, comprising the steps of (i) providing polyolefin; (ii) adding granules comprising halogen-based fire retardant material to the polyolefin, and forming a mixture; (iii) extruding filaments out of the mixture.

According to a fifth aspect, the present invention relates to a process for manufacturing artificial grass comprising the steps of (i) providing artificial fiber filaments; (ii) providing a backing; (iii) attaching the artificial fiber filaments to the backing, such that the artificial fiber filaments are extending from the backing.

According to the present invention, the inclusion of fire retardant additives during the fiber filament extrusion process is unique in its composition, manufacturing process and high fire retardant performance and therefore is suitable for use as indoor, high pile, artificial grass without requiring the use of any infill.

DRAWINGS

Figure 3:
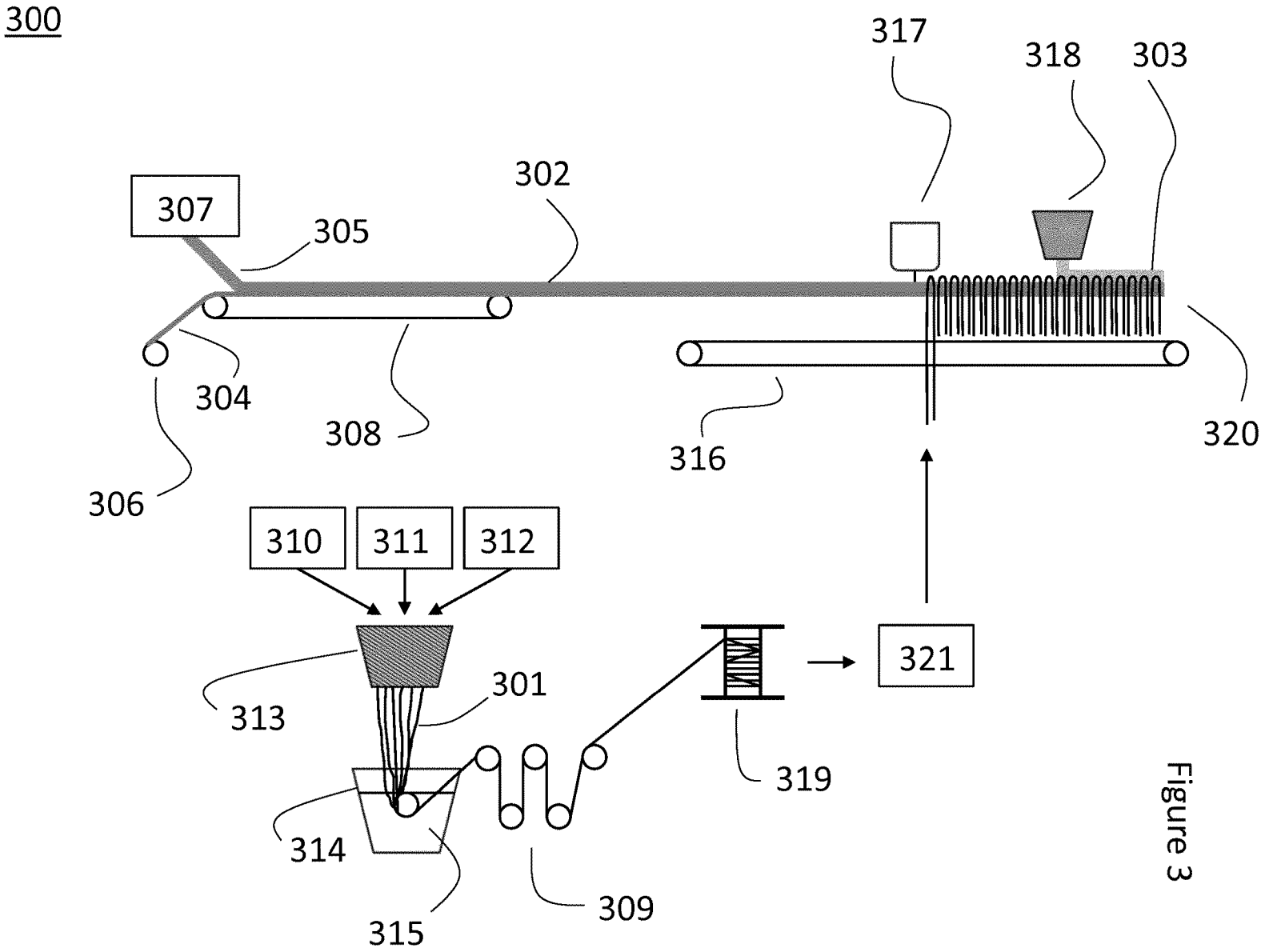

FIG. 3 schematically illustrates the production process of fire-retardant artificial grass in accordance with the present invention.

DETAILED DESCRIPTION OF THE INVENTION

An important characteristic of the present invention is the fact that fire retardant material is incorporated in the artificial grass fiber filaments to eliminate the need for special infill materials in indoor artificial grass. Particularly the selection of fire retardant material is important, since not all materials that are known to give fire retardancy properties, will in fact provide the artificial grass with the required fire retardancy properties, such as e.g. the $B_{fl}$ classification.

For the purpose of the further descriptions, with "artificial grass" is meant any surface with artificial fibers representing grass or grass-like strands.

The artificial fiber filament of the present invention comprises a polyolefin material and a halogen-based fire retardant material. In one preferred embodiment, the polyolefin comprises LLDPE. A preferred halogen-based fire retardant is a brominated fire retardant, preferably in combination with an antimonytrioxide synergist or agent. In one embodiment, the proportion of the active fire retardant component within the fiber filament is in the range of 1 to 30% by weight, preferably 2 to 25% by weight, and more preferably 3 to 23% by weight. According to one embodiment, the artificial fiber filament according to the present invention is substantially nitrogen free.

The artificial fiber filaments can be made by a process comprising the steps of (i) providing polyolefin; (ii) adding granules comprising halogen-based fire retardant material to the polyolefin, and forming a mixture; (iii) extruding filaments out of the mixture. For a preferred embodiment, coloring additives are added to the mixture, before the fiber filaments are extruded. In a more preferred embodiment, the process is used for producing the artificial fiber filaments as described above.

These artificial fiber filaments are used for forming an artificial grass, in particular for indoor applications. In an embodiment of the present invention the end-use of the grass product is meant exclusively for indoor applications, such as, but not limited to, meeting rooms, indoor playgrounds and exhibitions or tradeshows. An important difference between indoor and outdoor applications is that there is less exposure to UV light and therefore indoor grass generally requires a much lower level of UV resistance. The UV resistance referred to is related to the material strength (filament strength) after a certain time of exposure to UV light. As a consequence, the artificial grass of the present invention thus requires a lesser amount of UV stabilizers such as HALS (hindered amine light stabilizers). The amount of HALS active component required for indoor applications is preferably 0.01-0.2 weight %, whereas for outdoor applications it is typically in the range of 0.4 to 1.1 weight %. In one embodiment, the artificial grass is substantially free of UV stabilizers. This is a significant advantage since most of the UV stabilizers are not very chemically or physically compatible with most halogen-based fire retardant materials.

The artificial grass of the present invention comprises a plurality of artificial fiber filaments comprising a halogen-based fire retardant, and a backing, wherein the artificial fiber filaments are extending from the backing. The backing can be a single layer or a multi-layered structure. In case of a single layer, a woven or a non-woven can be used as backing. In case of a multi-layered structure, on top of the woven or non-woven backing, a reinforcing layer by means of a coating layer or an additional non-woven is preferably added. The single layer or multi-layered backing structure onto which fiber filaments are attached can be interpreted as the primary backing, onto which a secondary backing can be applied afterwards, in order to fix the attached artificial fiber filaments, in the art sometimes referred to as pile bonding. This secondary backing is for instance a latex binding. In one preferred embodiment, the artificial grass comprises artificial fiber filaments as specified hereinbefore.

In one embodiment, the artificial fiber filaments extend from the backing for at least a length of 8 mm wherein the stretched length varies across the artificial grass at most within a range of 20%, preferably not more than 10%. Further, the artificial fiber filaments may be attached to the backing by means well known to the person skilled in the art including, but not limited to tufting or woven techniques.

In one preferred embodiment, the backing also comprises one or more fire retardant materials. Possible fire retardant materials for the backing are for instance halogen containing compounds, other fire retardants known in the art, or combinations thereof. In an even more preferred embodiment, the backing comprises a halogen-based fire retardant material, preferably a brominated fire retardant.

In one preferred embodiment, the artificial grass according to the present invention has a so-called critical heat flux (CHF) of minimum 8 $kW/m^2$, whereas normally flammable products have a CHF of 3 $kW/m^2$ or less. The critical heat flux for flame ignition can be determined as the lowest thermal load per unit area capable of initiating a combustion reaction on a given material, according to EN ISO 9239-1.

In one preferred embodiment, the artificial grass according to the present invention has a light attenuation of ≤750%×min, measured according to EN ISO 9239-1.

In one preferred embodiment, the artificial grass according to the present invention has a vertical flame spread ($F_s$) lower than 150 mm, measured according to EN ISO 11925-2.

In one highly preferred embodiment of the present invention, the artificial grass has a fire retardant performance meeting at least the standardized $B_{fl}$ fire class, according to EN 13501-1.

It is particularly noted that the high performance classification of the artificial grass of the present inventions is achieved without using infill, such as sand, or rubber pellets or other fire retardant material. Therefore, in one embodiment, the artificial grass does not comprise infills.

The artificial grass of the present invention can be manufactured by a process comprising the steps of (i) providing artificial fiber filaments comprising halogen-based fire retardant as explained hereinbefore; (ii) providing a backing; (iii) attaching the artificial fiber filaments to the backing, such that the artificial fiber filaments are extending from the backing.

According to the present invention, the inclusion of fire retardant additives during the fiber filament extrusion process is unique in its composition, manufacturing process and high fire retardant performance for the specific application of indoor high pile artificial grass and without using any infill.

DESCRIPTION OF SPECIFIC EMBODIMENTS

Figure 1:
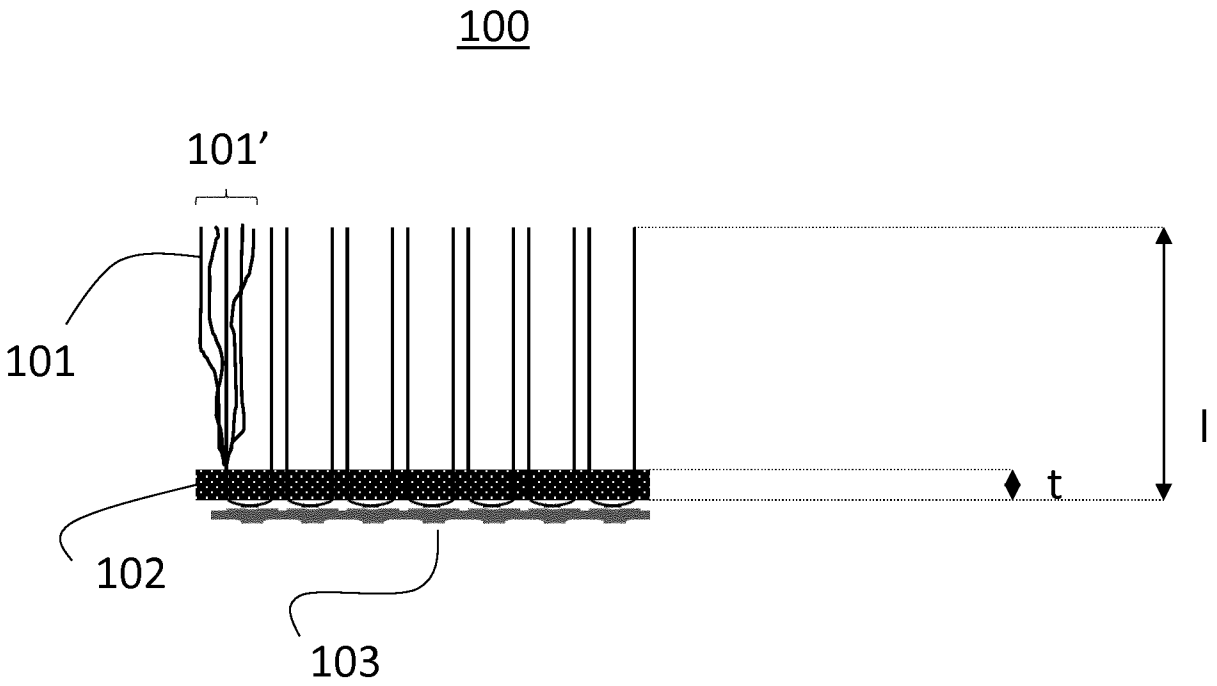
FIG. 1 shows an exemplary embodiment of fire-retardant artificial grass in accordance with the present invention.

Having the basic scheme or cross section of a fire retardant artificial grass 100 according to the present invention illustrated in FIG. 1, a plurality of artificial fiber filaments 101 comprising fire retardant material, are attached to a backing 102. More particularly, the artificial fiber filaments 101 are tufted as artificial fiber filament bundles 101' through the backing 102. According to an embodiment, the artificial fiber filament bundles 101' comprise between 1 and 32 artificial fiber filaments 101. The backing 102 may be, but not being limited to, a woven (polyolefin) tape backing, or a nonwoven. Below the tufted backing 102, a latex binding may be applied as supplementary backing 103, gluing the tufted structure together. With the supplementary backing 103, the artificial fiber filaments 101 are for instance better attached or fixed to the backing 102. This supplementary backing 103 can comprise of, not being limited to, a latex layer, polyolefin sheets and hot melt glue coatings. The backing 102 has a thickness t of 0.43 mm preferably 0.3-0.5 mm whereas the length l of the tufted artificial fiber filaments 101, extending from the backing 102 is at least 8 mm, preferably at least 15 mm, and more preferably at least 20 mm. All artificial fiber filaments 101 approximately have the same stretched length l, however for an entire lawn, this length may vary within a range of 10-20%. The artificial fiber filaments 101 preferably have a cross-section selected from, but not limited to, a rectangular, an elliptical, a trilobal or a C-shaped cross section, and have dimensions of e.g. 50-300 μm thickness and 0.2-2 mm width.

The artificial fiber filaments 101 comprising the fire retardant material, are for instance made of LLDPE as polyolefin basic substrate or carrier, into which e.g. a halogen-based fire retardant is incorporated, as well as for example coloring pigment additives. The halogen-based fire retardant, such as brominated fire retardant with antimonytrioxide synergist or agent, is typically supplied in granules format (irregular with volume in the $mm^3$ range) and mixed together with polyolefin and coloring additives as main ingredients before the extrusion process is executed. The artificial fiber filaments 101 when comprising for example brominated fire retardant with antimonytrioxide synergist, are provided with a fire retardant active component of 1-30% by weight, preferably 2-25% by weight, and more preferably 3-23% by weight. The coloring additives masterbatch consists of 5-60% by weight pigments and 40-95% by weight carrier (preferably LDPE). An example of a masterbatch contains 25% by weight pigments and 75% by weight LDPE, of which for instance 3% of the masterbatch is contained in the mixture to have a light color effect, whereas an amount of 8% is more convenient for a deep colored mat. The thickness of the artificial fiber filament bundles 101' is for example between 2500 and 5000 dtex, preferably between 3000 and 4500 dtex. These artificial fiber filament bundles 101' comprise of individual artificial fiber filaments 101 with dtex between 300 to 1000 dtex, and according to a specific embodiment the artificial fiber filaments 101 have between 550 and 750 dtex. All artificial fiber filaments 101 approximately have the same length.

Figure 2:
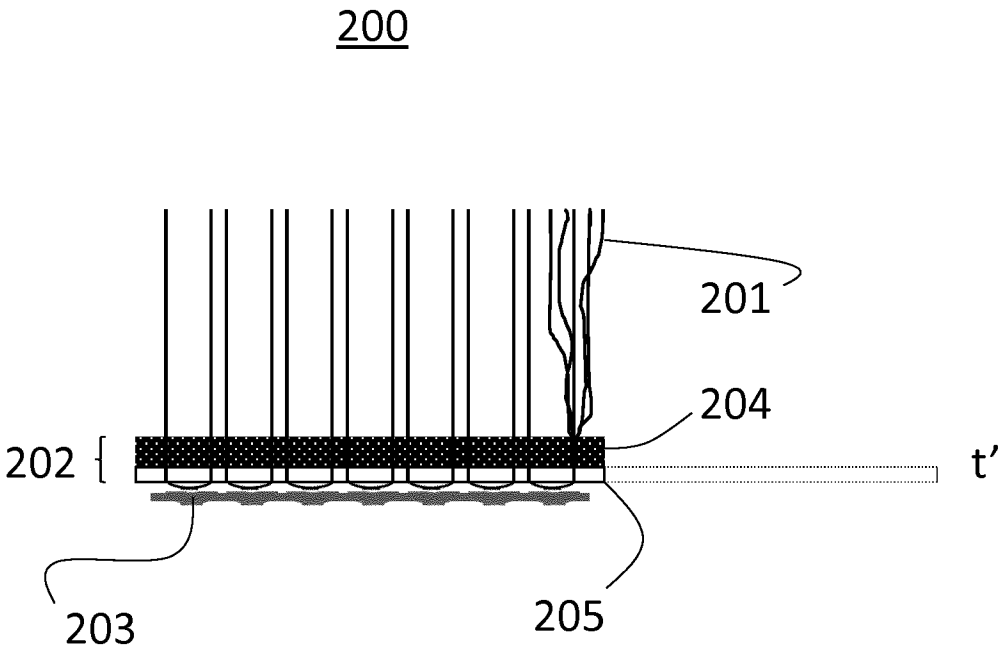
FIG. 2 shows another exemplary embodiment of fire-retardant artificial grass in accordance with the present invention.

Another exemplary embodiment of the fire retardant artificial grass 200 in accordance with the present invention is depicted in FIG. 2. Here the backing 202 comprises a two-layered structure, i.e. represents a backing substrate 204 and a reinforcing layer 205, this latter being for example a needlefelt non-woven or else a particular coating layer, and having a thickness t' of 0.1 to 2 mm, preferably between 0.1 and 0.5 mm. This reinforcing layer 205, having a density of e.g. 30-200 $g/m^2$, preferably 50-150 $g/m^2$, can be added for pile locking of the artificial fiber filaments 101. Artificial fiber filaments 201 comprising fire retardant material are tufted through the backing 202, and again a supplementary backing 203 is applied e.g. by means of a latex binding. Moreover, the supplementary backing 203 is also provided with a fire retardant material, as for example of the halogen-based type, possibly a brominated fire retardant, possibly similar or identical to the fire retardant incorporated within the extruded artificial fiber filaments 201. Further, the supplementary backing 203 is for instance a fire retardant latex backing, comprising of a halogen containing additive as well as alumina trihydrate (ATH) additive. In terms of proportions, the halogen containing additive is provided in the supplementary backing 203 e.g. for 3% dry weight of backing 203, whereas ATH additive is included e.g. for 73% dry weight. The fire retardant latex backing 203 for example has a thickness of 0.1 to 1.5 mm, preferably between 0.5 and 0.7 mm. Alternatively, the backing substrate 204 as basic part of the backing 202 and/or the reinforcing layer 205 may also comprise a fire retardant. Depending for example on the material used as backing substrate 204 and/or reinforcing layer 205 the appropriate fire retardant needs to be searched for.

FIG. 3 illustrates a process scheme for manufacturing fire retardant artificial grass 320 in accordance with the present invention. Starting with a roller 306 from which a backing substrate 304 such as a woven or a non-woven is unwound, a line 308 is consecutively arranged during which a reinforcing layer 305 is provided on top of this backing substrate 304. The reinforcing layer 305 can in turn be unwound from a roll represented by the stage 307, or else the stage 307 may be a tank out of which a reinforcing layer 305 is delivered in fluid state and hence directly applied onto the backing substrate 304, for the line 308 being active. Possibly, the backing substrate 304 and/or the reinforcing layer 305 are provided with a fire retardant material, for example comprising halogen-based additive. At the end of stage 308, the primary backing 302, as a combination of the backing substrate 304 and the reinforcing layer 305, is formed. The reinforcing layer 305 is attached to backing substrate 304, for example by needling, calandering or adhesives.

Further, an extruder tank 313 is part of the production set-up, out of which multiple artificial fiber monofilaments 301 are extruded and lead to a bath 314 filled with water and process additives 315 in order to cool down the extruded filaments 301. The ingredients 310, 311, 312 for the extrusion process as shown here, are polyolefin 310, halogen-based flame retardant material 311 e.g. in the shape of granules and color additives 312. When led out of the bath 314, the artificial fiber monofilaments 301 are propagated towards a drafting unit or accumulator set-up 309 for strengthening the artificial fiber filaments 301. Next, having left the accumulator set-up 309, the filaments 301 are wound onto a bobbin 319. Whereas the filaments 301 are still loose filaments in this phase (when wound onto the bobbin 319) a following stage 321 is foreseen in order to process a so-called multifilament yarn. This can be done by wrapping a binding thread around the filaments 301, to keep the filaments together which forms a yarn. Alternatively as represented by stage 321, the filaments 301 are crimped or texturized and then twisted to form a yarn. Having finished stage 321, the yarn-like artificial fiber filaments 301 can now be provided for being attached, e.g. by means of tufting techniques, to the primary backing 302.

Further continuing the process now with the primary backing 302 being finished at the end of line 308, at consecutive stage 316 the primary backing 302 is further propagated towards a tufting installation 317. The artificial fiber filaments 301 are delivered from stage 321, as described before, and hence tufted through the primary backing 302. Besides the tufting equipment 317, by means of which artificial fiber filaments 301 are attached, the line 316 is subsequently provided with a tank 318, ejaculating a secondary backing 303, being applied onto the tufted structure and thereby loop pile bonding with e.g. a latex binding the tufted structure. Possibly the secondary backing 303 is provided with fire retardant material, and hence for instance being a fire retardant latex backing. At the end of the line 316, the production of the fire retardant artificial grass 320 is accomplished.

Experiment Related to Standardized $B_{fl}$ Fire Class

The main European standard used to classify flame retardant products is EN 13501-1, i.e. more specifically the fire classification of construction products and building elements using test data from reaction to fire tests. Highest performance flame retardant fire class $B_{fl}$ is achieved when corresponding and standardized testing procedures EN ISO 9239-1 and EN ISO 11925-2 are successfully executed and required results are achieved.

A few fire retardant artificial grass samples, characterized by having a different pile height, are tested according to the procedure EN ISO 9239-1 in order to measure the critical heat flux (CHF) and according to the procedure EN ISO 11925-2 in order to determine that the vertical flame spread ($F_s$) is lower than 150 mm vertically from the point of application of the test flame within 20 sec from the time of application, and hence investigate the samples for $B_{fl}$ fire classification.

Each artificial grass mat sample comprises fire retardant polyolefin fiber filaments and fire retardant latex backing. The fire retardant artificial grass filaments, comprising 11-14 active % by weight of a brominated fire retardant with antimonytrioxide synergist, whereas the fire retardant latex backing comprises a halogen containing additive as well as alumina trihydrate (ATH) additive.

For EN ISO 9239-1, all test samples have dimensions of 1050 mm×230 mm. Each test sample is loose laid on a fiber cement board, but the edges of the sample are held by double-sided adhesive tape on the underlay board. The sample edges are also mechanically clamped to the underlay board by means of a special metal frame. During the first 2 minutes of the horizontal test in accordance with EN ISO 9239-1, the flooring samples are preheated by means of a radiant panel, whereas the following 10 minutes, the samples are further exposed to heat from the radiant panel including flame ignition. Environmental conditions are approximately 23° C. temperature and about 50% humidity.

The pile height of the fiber filaments extending from the latex backing of a test sample is respectively 9 mm, 20 mm and 30 mm, whereas the total thickness of the mat is respectively 10 mm, 22 mm and 32 mm. The total surface mass varies from 2700 g/m$^2$ to 2600 g/m$^2$ to 2150 g/m$^2$ with increasing pile height of respectively 9 mm to 20 mm to 30 mm. The corresponding pile weight of the test samples lies in the range of 800 to 1000 g/m$^2$.

The exposed heat radiation is maintained for 30 minutes. After the 30 minutes test duration the CHF [kW/m$^2$] is determined from the maximum flame spread distance in accordance with the regular calibration. The highest flame retardant performance standard, is defined by the fire class $B_{fl}$ for which CHF 8 kW/m$^2$, according to EN 13501-1. The test results for each of the pile heights are given below.

| Pile height (mm) | Sample direction | Number | CHF (kW/m$^2$) |
|---|---|---|---|
| 9 | Longitudinal | 1 | 10.1 |
| | Transversal | 1 | 9.9 |
| | Transversal | 2 | 10.3 |
| | Transversal | 3 | 9.9 |
| | AVG | | 10.0 |
| 20 | Longitudinal | 1 | 10.9 |
| | Transversal | 1 | 10.7 |
| | Transversal | 2 | 9.6 |
| | Transversal | 3 | 10.9 |
| | AVG | | 10.4 |
| 30 | Longitudinal | 1 | 10.4 |
| | Transversal | 1 | 10.7 |
| | Transversal | 2 | 10.4 |
| | Transversal | 3 | 10.4 |
| | AVG | | 10.4 |

For each of the different pile height test samples, the critical heat flux CHF is above the minimum value of 8 kW/m$^2$, which means one requirement for $B_{fl}$ classification is fulfilled.

Besides CHF, the smoke production is also evaluated in EN ISO 9239-1. Here, the measured parameter is the light attenuation. According to the standard $B_{fl}$ fire classification, the total light attenuation for s1 classification is ≤750%× min.

| Pile height (mm) | Sample direction | Max light att. (%) | Total light att. (% X min) |
|---|---|---|---|
| 9 | Longitudinal | 20.0 | 88.3 |
| | Transversal | 17.1 | 90.2 |
| | Transversal | 32.0 | 137.8 |
| | Transversal | 11.0 | 87.1 |
| | AVG | 20.0 | 105.0 |
| 20 | Longitudinal | 18.8 | 81.8 |
| | Transversal | 23.6 | 106.9 |
| | Transversal | 34.8 | 160.3 |
| | Transversal | 15.0 | 103.1 |
| | AVG | 24.5 | 123.4 |
| 30 | Longitudinal | 11.9 | 89.3 |
| | Transversal | 22.2 | 94.3 |
| | Transversal | 7.6 | 80.2 |
| | Transversal | 7.9 | 64.9 |
| | AVG | 9.1 | 78.1 |

As a conclusion, it can be clearly stated that all test samples satisfy the light attenuation requirement for s1 classification.

The final requirement for $B_{fl}$, according to the classification standard EN 13501-1, is that the vertical flame spread ($F_s$) is lower than 150 mm, measured vertically from the point of application of the test flame within 20 sec from the time of application, according to EN ISO 11925-2. This vertical test is less severe and less critical compared to the radiant floor panel test EN ISO 9239-1, but the results are also given below. Besides the $F_s$, also the presence of burning drips, which can ignite the filter paper under the sample during the fire test, is mentioned below.

| Pile height (mm) | Sample direction | Number | $F_s$ (mm) | Filter paper burns |
|---|---|---|---|---|
| 9 | Longitudinal | 1 | ≤150 | No |
| | | 2 | ≤150 | No |
| | | 3 | ≤150 | No |
| | Transversal | 1 | ≤150 | No |
| | | 2 | ≤150 | No |
| | | 3 | ≤150 | No |
| 20 | Longitudinal | 1 | ≤150 | No |
| | | 2 | ≤150 | No |
| | | 3 | ≤150 | No |
| | Transversal | 1 | ≤150 | No |
| | | 2 | ≤150 | No |
| | | 3 | ≤150 | No |
| 30 | Longitudinal | 1 | ≤150 | No |
| | | 1 | ≤150 | No |
| | | 2 | ≤150 | No |
| | Transversal | 1 | ≤150 | No |
| | | 2 | ≤150 | No |
| | | 3 | ≤150 | No |

For each of the different test samples, the maximum vertical flame spread $F_s$ is lower than 150 mm, and there is no presence of burning molten drips that ignite the filter paper. Therefore, the test results fulfill the requirements for ISO 11925-2 to obtain $B_{fl}$ classification As a conclusion, it can be clearly stated that all test samples satisfy all requirements, both for EN ISO 9239-1 as EN ISO 11925-2, to be certified as $B_{fl}$-s1 according to EN 13501-1 classification for flooring products.

The invention claimed is:

1. An artificial grass consisting of artificial fiber filaments, a backing, and a supplementary backing, wherein the artificial fiber filaments extend from the backing and consist of a polyolefin material and a halogen-based fire retardant material, and wherein the supplementary backing is a latex backing comprising a halogen-based fire-retardant material and an alumina trihydrate (ATH) additive, wherein the artificial fiber filaments extend from the backing for at least a length of 15 mm, wherein the length varies across the artificial grass at most within a range of 20%, and wherein all the artificial fiber filaments comprise a halogen-based fire retardant material.

2. The artificial grass according to claim 1, wherein the backing comprises a fire retardant material.

3. The artificial grass according to claim 2, wherein the fire retardant material of the backing is a halogen-based fire retardant material.

4. The artificial grass according to claim 1, having a fire retardant performance meeting at least the standardized $B_{fl}$ fire class according to EN 13501-1.

5. The artificial grass according to claim 1, wherein the artificial fiber filaments comprise less than 0.4 weight % UV-stabilizer.

6. A process for manufacturing the artificial grass according to claim 1, comprising: (i) providing the artificial fiber filaments comprising consisting of a polyolefin material, and a halogen-based fire retardant material; (ii) providing the backing; (iii) attaching the artificial fiber filaments to the backing, such that the artificial fiber filaments are extending from the backing for at least a length of 15 mm and wherein the length varies across the artificial grass at most within a range of 20%; and (iv) applying a supplementary backing, and wherein all the artificial fiber filaments in the manufactured grass comprise a halogen-based fire retardant material.

7. The artificial grass of claim 1, wherein the halogen-based fire retardant material is a brominated fire retardant.

8. The artificial grass of claim 1, wherein the halogen-based fire retardant material is present in the artificial fiber filaments from 1 to 30% by weight.

9. The artificial grass of claim 1, wherein the halogen-based fire retardant material is present in the artificial fiber filaments from 2 to 25% by weight.

10. The artificial grass of claim 1, wherein the halogen-based fire retardant material is present in the artificial fiber filaments from 3 to 23% by weight.

11. The artificial grass of claim 1, wherein the polyolefin material of the artificial fiber filaments is LLDPE.

* * * * *